United States Patent [19]

Glotin

[11] 4,043,390

[45] Aug. 23, 1977

[54] ANCHORING DEVICE AND RUNNING TOOL FOR DOWNHOLE APPARATUS

[75] Inventor: Bernard Jean-Pierre Glotin, Saint Maur, France

[73] Assignee: Schlumberger Technology Corporation, New York, N.Y.

[21] Appl. No.: 740,648

[22] Filed: Nov. 10, 1976

[30] Foreign Application Priority Data

Nov. 19, 1975 France ..... 75.35272

[51] Int. Cl.[2] ..... E21B 23/00

[52] U.S. Cl. ..... 166/215; 166/125; 166/217

[58] Field of Search ..... 166/215, 214, 217, 137, 166/181, 125

[56] References Cited

U.S. PATENT DOCUMENTS

| | | | |
|---|---|---|---|
| 2,358,466 | 9/1944 | Miller | 166/217 |
| 2,401,119 | 5/1946 | Taylor, Jr. | 166/137 |
| 2,887,163 | 5/1959 | McGowen Jr. et al. | 166/217 |
| 2,980,185 | 4/1961 | Daffin | 166/125 |
| 3,593,784 | 7/1971 | Brown | 166/125 |

*Primary Examiner*—James A. Leppink
*Attorney, Agent, or Firm*—David L. Moseley; William R. Sherman; Stewart F. Moore

[57] ABSTRACT

In accordance with an illustrative embodiment of the present invention, there is disclosed herein a device for anchoring downhole apparatus such as a safety valve in a tubing landing nipple, and a running tool for lowering the anchoring device at the end of a wire line into the tubing.

The anchoring device comprises a body member that carries locking dogs which are shifted outwardly and engaged by the longitudinal movement of an expander mandrel. An expansible ring that is maintained on the mandrel by shear pins functions to lock the mandrel in the engaged position of the dogs. The running tool comprises a control sleeve having pivotally mounted connecting keys which remain engaged with the mandrel until the locking dogs are properly engaged and which then are released automatically from the mandrel. A safety shear pin makes it possible to free the running tool from the anchoring device in the event of incorrect anchoring of the latter and, when sheared, provides a "tell-tale" of incorrect installation.

15 Claims, 5 Drawing Figures

ANCHORING DEVICE AND RUNNING TOOL FOR DOWNHOLE APPARATUS

This invention relates to an anchoring device for securing an apparatus such as a safety valve at a predetermined depth in a well conduit, and to a running tool designed to be lowered at the end of a wire line for installing such anchoring device.

It is frequently necessary to install an apparatus such as a safety valve at a predetermined depth in the production string of an oil or gas well. A conventional technique consists in previously inserting in the production string at the desired depth a tubular seat or landing nipple intended to receive an anchoring device. The apparatus to be installed is connected at the surface to the anchoring device and the assembly is lowered into the production string by means of a running tool suspended from the end of a wire line. Jars placed immediately over the running tool make it possible to apply upward or downward impacts to the tool in order to lock the anchoring device in the landing nipple and then to separate the anchoring device from the running tool which can then be raised to the surface.

A conventional anchoring device comprises locking dogs which move outward to engage in an internal groove in the landing nipple. The outward movement of the dogs is caused by the longitudinal movement of an internal slide. One of the main problems with this type of anchoring device consists in achieving effective locking of the dogs while allowing unlocking when it is desired to withdraw the anchoring device from the landing nipple.

It is one object of this invention to provide a new and improved anchoring device that includes a system for automatically locking the device in the anchored position, and which requires shearing to enable release.

There also are many prior art running tools used for the installation of such anchoring devices. Their role is to lower the anchoring device down to the desired depth and to anchor this device in the landing nipple. The running tool can be fixed to the body of the anchoring device by means of pins which are sheared to free the running tool from the anchoring device after the installation of the latter. One drawback of prior art running tools is that they can be freed from the anchoring device even if the locking dogs are not properly anchored, and there is thus no assurance that anchoring has in fact taken place.

Another object of the invention is to provide a new and improved running tool having a safety system which indicates whether the locking dogs of the anchoring device have been correctly engaged in their seat.

These and other objects of the present invention are attained through the provision of an anchoring device comprising a tubular body member having wedges or dogs mounted movably in the wall thereof so that they can be moved out so as to extend beyond the outside of the body member. An expander mandrel is slidably mounted in the body member and is adapted to move the dogs out when it is shifted from a releasing position to a blocking position. The anchoring device further includes locking means for securing the mandrel when it reaches the blocking position, such locking means comprising an element capable of being sheared to free the mandrel from such blocking position. A spring biases the mandrel from the releasing position toward the blocking position. The locking means preferably include a flexible element such as expansible, split ring designed to engage laterally in a recessed part of the body member, a retaining element to secure longitudinally the flexible element on the mandrel, and a shear pin releasably connecting the retaining element to the locking mandrel.

According to another feature of the present invention, a running tool for installing the aforesaid anchoring device comprises a tubular support, a control sleeve slidable in the in the support, and connecting keys pivotally mounted on the sleeve and adapted to engage the locking mandrel of the anchoring device. Means maintain the connecting keys engaged in the mandrel as the sleeve is moved between first and second positions corresponding respectively to the releasing and blocking positions, and then free the connecting keys from the mandrel when the sleeve reaches the second position. A spring biases the control sleeve toward the second position and a shear pin secures the sleeve in the first position. Safety means are provided to make it possible to disengage the connecting keys from the mandrel when the control sleeve is lodged between the first and second position. The functioning of the safety means provides an indication that the anchoring device has not been anchored correctly.

The present invention has other objects and advantages which will become more readily apparent in connection with the following description, taken in conjunction with the appended drawings in which.

Figure 1:
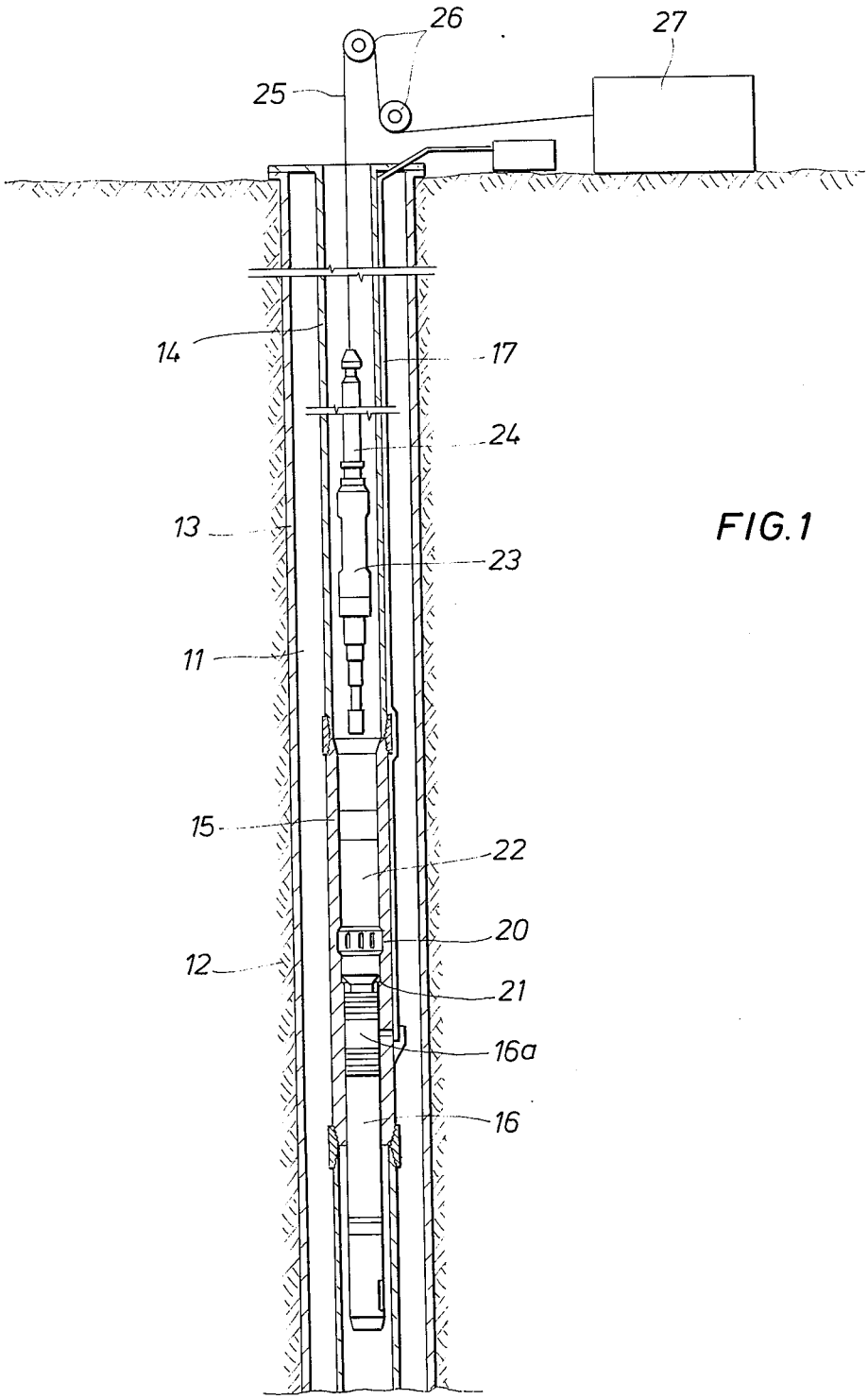
FIG. 1 is a diagram of the system according to the invention shown in a well after placing of the anchoring device.

Referring initially to FIG. 1, a well bore 11 traversing earth formations 12 is lined with a casing 13 having a production of string of tubing 14 located therein. A landing nipple 15 connected in the tubing string 14 is located at a selected depth in the well, and is adapted to receive an anchoring device 22 from which other apparatus, for example of a safety valve 16 is suspended. A hydraulic line 17 may be installed along the production string to provide for surface control of the valve 16. The hydraulically operated safety valve is mentioned here only by way of example, as other apparatus may be installed in the nipple 15 to control the flow or pressure of the well or to measure various downhole parameters.

The landing nipple 15 may include, in a conventional manner, an internal annular groove 20 and an upwardly facing stop shoulder 21. The apparatus 16 is attached to the lower end of the anchoring device 22 by an adapter sub and a seal mandrel **16*a* which carries spaced-apart seals arranged to engage the seal bore of the landing nipple above and below a side port which communicates with the hydraulic line 17. The running tool 23 is connected to an assembly 24 comprising mainly weights and a typical jar, this assembly being moved through the tubing 14 by means of a flexible wire line 25 which runs over pulleys 26 and winds on a surface winch 27. In FIG. 1, the anchoring device 22 has just been placed in the nipple 15 and the running tool 23** disconnected therefrom to allow the running tool to be retrieved to the surface.

Figure 2A:
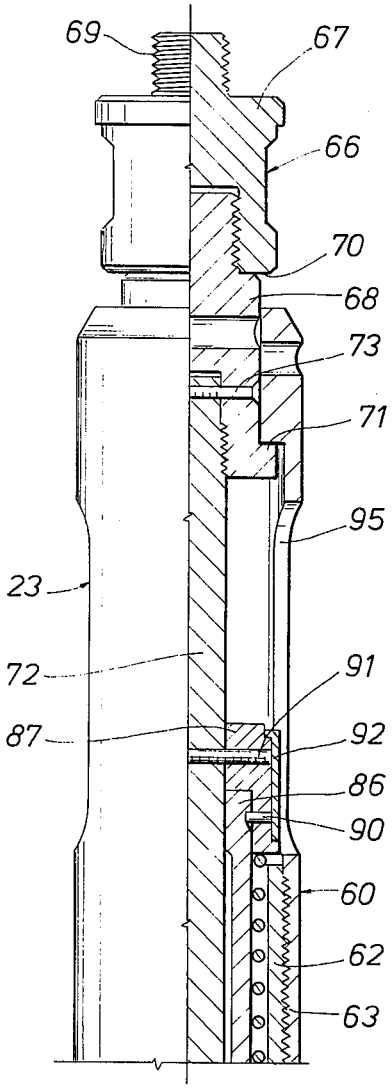
FIGS. 2A and 2B are longitudinal views, in partial section, of the anchoring device and the running tool according to the invention coupled together and arranged for running into a well conduit.
Figure 2B:
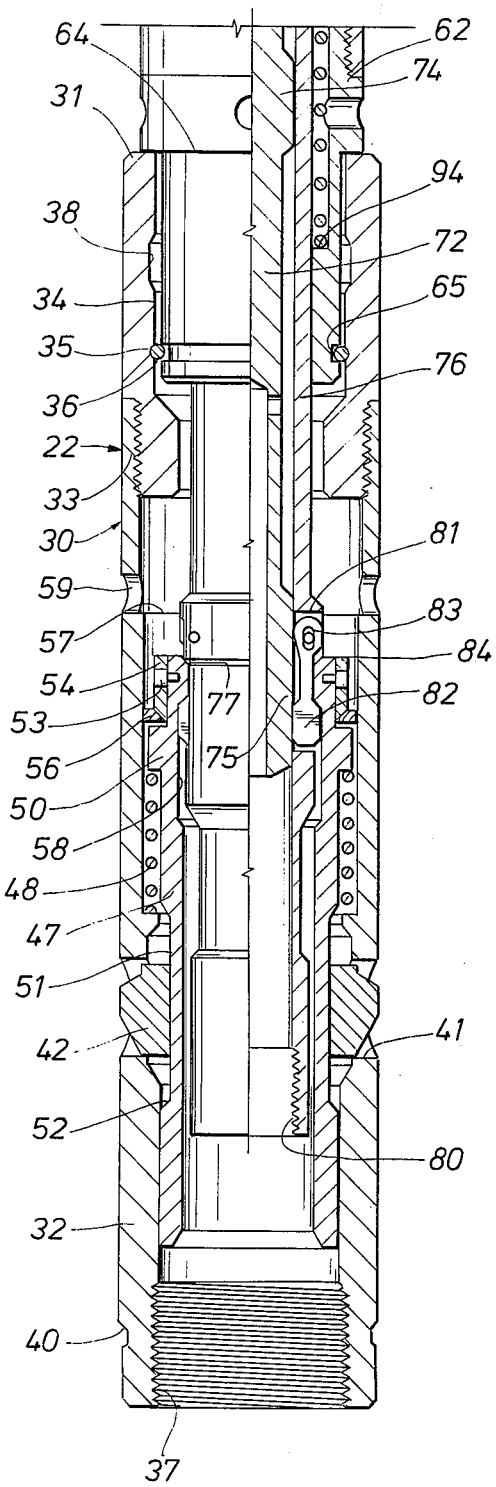

Referring now to FIGS. 2A and 2B, the anchoring device 22 and the running tool 23 are shown in greater detail, connected to each other as, for example, during their lowering into the borehole. The left-hand side of the running tool 23 is shown in elevation rather in section. The anchoring device 22 comprises a tubular body member 30 made up of a top sub 31 and a bottom sub 32 screwed end to end by a thread 33. The top sub 31 of the body member has a longitudinal bore 34 designed to receive the body of the running tool 23. Two parallel horizontal holes 35 are provided to either side of the top sub 31 tangentially in relation to the bore 34 to receive shear pins 36 which secure the running tool to the top sub. A fishing groove 38 also is provided near the top of the bore 34. The bottom sub 32 of the body 30 is provided with threads 37 into which may be screwed the apparatus 16, and an external shoulder 40 is sized and adapted to bear on the stop shoulder 21 of the landing nipple 15 (FIG. 3B) in a "no-go" fashion. Above the shoulder 40 and at a distance equal to that between the shoulder 21 and the groove 20 of the nipple 15, the bottom sub 32 of the body is provided with a plurality, for example eight, radially directed and regularly spaced openings 41. A dog 42 is received in each opening 41 and is capable of moving between a retracted position as shown in FIG. 2B and an engaged position in which the outer periphery of the dog projects beyond and outside of the body 30. Each dog has a cylindrical inner face and, on the outside, a bearing face, also cylindrical, extending upward and downward by two inclined sides. Each dog also has two retaining heels (not shown) extending beyond each of its lateral sides to prevent the dog from slipping out of the body through the openings 41.

Figure 3A:
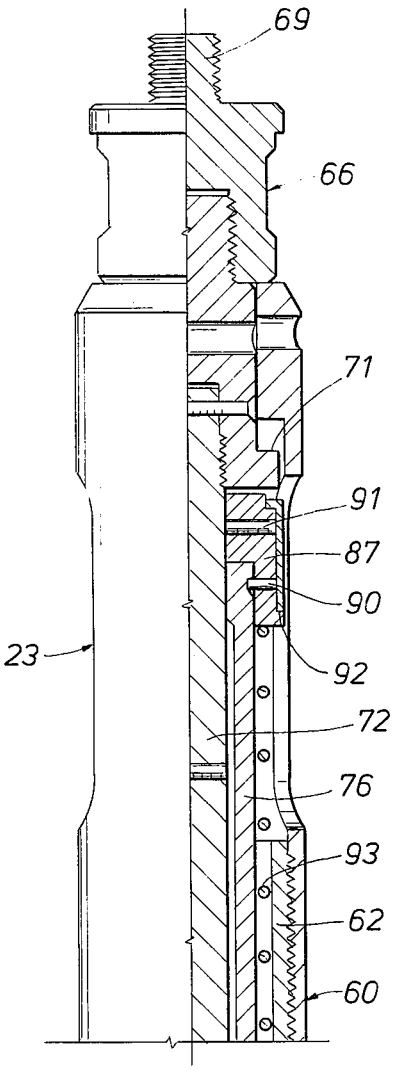
FIGS. 3A and 3B are views similar to FIGS. 2A and 2B but showing the anchoring device in the anchoring position in a production string.
Figure 3B:
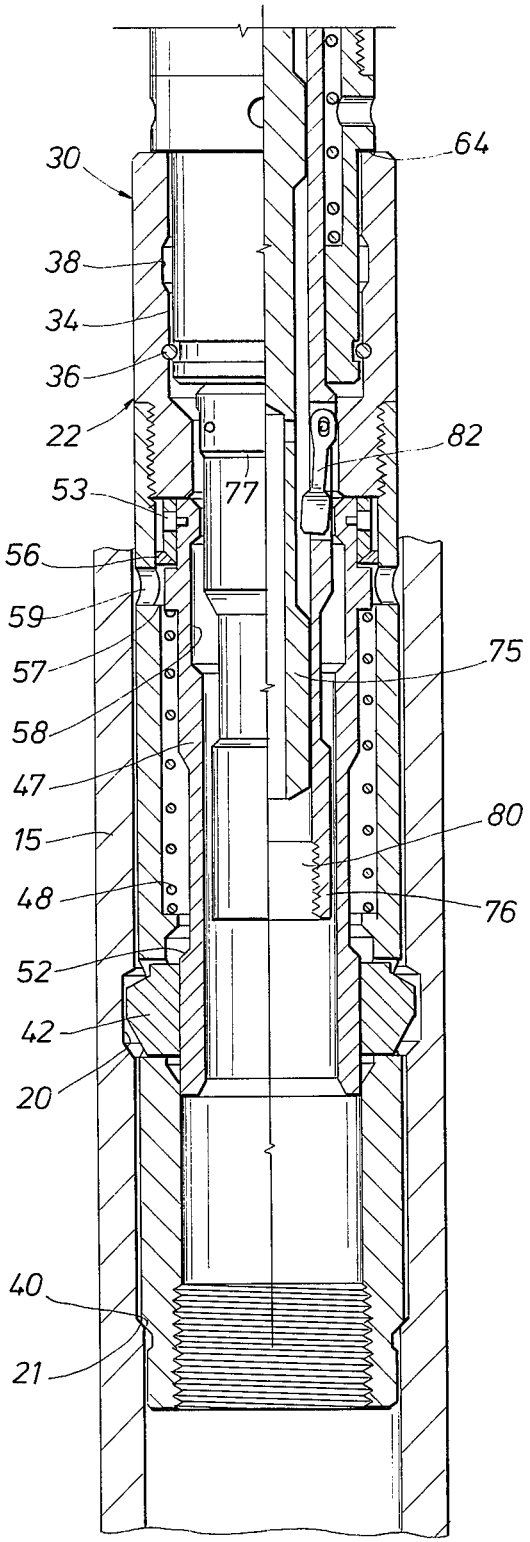

An expander mandrel 47 is mounted inside the bottom sub 32 of the body and can be moved between a lower position represented in FIG. 2B and an upper position represented in FIG. 3B. A helical spring 48 reacts an compression between a shoulder of the body and an annular projection 50 of the mandrel 47 and biases the latter upward. An annular groove 51 is cut on the periphery of the mandrel 47 so that it is opposite the dogs 42 when the mandrel is in the lower position to thereby allow the dog to retract. On the other hand, the enlarged diameter lower portion of the mandrel 47 in the upper position (FIG. 3B) keeps the dogs extended. The bottom wall 52 of the groove 51 is inclined to spread or expand the dogs when the mandrel is moved upward.

A crown ring 54 is fixed by means of shear pins 53, to the top portion of the mandrel 47 in a manner to leave between it and the top face of the projection 50 an annular space in which is placed a detent such as an expansible, elastic, split ring 56. The body 30 has an inner shoulder 57 directed upward. The shoulder 57, the flexible ring 56 and the crown ring 54 comprise locking means for securing the slide when it reaches its upper position. In the upper position, the ring 56 can move outwardly under the effect of its elasticity to come out against the recessed part of the body located over the shoulder 57 (FIG. 3B). Any downward movement of the slide is thus prevented by the ring 56 which is located between the body shoulder 57 and the crown ring 54. It will be noted that the bottom face of the crown ring 54 and the top face of the flexible ring 56 are inclined so that a downward relative movement of the mandrel 47 tends to further expand the flexible ring 56. In the inner wall of the mandrel 47 is cut an annular groove 58 designed to receive keys which connect the running tool 23 as will be seen further below. Openings 59 are provided through the wall of the body 30 just above the shoulder 57 for fluid ingress and egress.

In operation, the expander mandrel 47 is kept in the lower position throughout the lowering of the device 22 into the tubing. The achoring device 22 is introduced into the landing nipple 15 until the shoulder 40 stops against the shoulder 21. The mandrel 47 is then freed as will be subsequently described and moved upward under the action of the spring 48 to thereby engage the dogs in the groove 20 of the nipple 15 as shown in FIG. 3B. When the mandrel 47 reaches the upper position, it is automatically locked in such position by the expansible ring 56. To lower the mandrel 47 and thus free the dogs 42, it is first necessary to shear the pins 53 which ensures highly reliable anchoring.

The running tool 23 comprises an elongated tubular support 60 made up of a top sub 61 and a bottom sub 62 screwed to each other by a thread 63. The bottom sub 62 has a reduced diameter lower portion designed to fit into the bore 34, and a shoulder 64 which comes up against the top face of the body 30 of the anchoring device 30. An internal annular groove 65 is cut out near the bottom of the lower portion and receives the tangential shear pins 36 which lock the running tool to the anchoring device 22. A head 66 made up of two parts 67 and 68 screwed to each other is slidably mounted in the top sub 61 of the support 60 with a short stroke movement limited downward and upward by shoulders 70 and 71. The head 66, of which the top part has a threaded boss 69, is extended downward by an axial rod 72 screwed into the part 68 and locked by a pin 73 to prevent rotation. The axial rod 72 is generally cylindrical and has an intermediate flange 74 and a bottom flange 75, both of enlarged section. This rod is designed to enable withdrawal of the connecting keys from, and engagement of the keys with, the expander mandrel 47 of the anchoring device as will be explained later on.

A control sleeve 76 is slidably mounted between the support 60 and the axial rod 72 and has an inner surface which slides against the flanges 74 and 75 of the axial rod. The bottom part of the control sleeve 76 is sized to be introduced into the bore of the mandrel 47 of the anchoring device 22. The sleeve 76 has an annular stop shoulder 77 of enlarged diameter which comes up against the top face of the mandrel 47. A thread 80 is provided at the bottom end of the sleeve 76. Two diametrically-opposed recesses 81 go through the control sleeve 76 substantially at the level of the stop 77, and each recess 81 receives a connecting key 82. The top part of each key 82 is pierced with a longitudinal slot 83 and is hinged on a pivot spin 84 fixed to the sleeve 76. Due to the elongated nature of the slots 83, each key 82 can move vertically between two positions respectively abutting the top and bottom faces of the recess 81, and vertical force exerted on the keys is thus applied to the top and bottom faces of the recesses 81 rather than to the pivots 84.

When the control sleeve 76 is placed vertically in relation to the axial rod 72 so that the bottom of the recesses 81 is opposite the flange 75 (FIG. 2B), the keys 82 have their heels against this flange and are consequently kept in an extended position in which they are projected beyond the outline of the control sleeve. If the connecting keys 82 have been previously engaged in the groove 58 of the mandrel 47, the latter is then solidly connected with the control sleeve 76 as long as the heels of the keys are against the flange 75. If the sleeve 76 is moved upward or downward until the heels of the keys 82 reach beyond the edges of the flange 75, the keys 82 can retract (FIG. 3B) thereby freeing the mandrel 47.

The control sleeve 76 further comprises an inwardly thickened upper end 86 on which is fitted a cap 87 fixed to this end by pins 90. The cap 87 is secured temporarily on the axial rod 72 by a transverse shear pin 91. A sheath 92 covers the cap 87 and prevents the pins from getting out. When the pins 90 and 91 are in place, the control sleeve has a vertical position in which the keys 82 are moved out by the flange 75. The bottom of the cap 87 is then located immediately over the top face of the sub 62 of the support 60. A helical spring 93 reacts between the bottom of the cap 87 and a shoulder 94 on the support 60 to bias the control sleeve 76 upwardly. Elongated openings 95 cut out in the support 60 to allow access to the cap 87 to place the pins 90 and 91.

In operation, apparatus, for example a safety valve 16 and a seal mandrel 16*a,* is first screwed onto the threads 37 at the bottom end of the anchoring device 22. The running tool 23 without the pin 91 is introduced into the bore 34 and the support 60 is secured in the top sub 31 of the body by means of the tangential shear pins 36. Then, through the bottom is inserted a long threaded rod (not shown) which is screwed into the thread 80 at the lower end of the control sleeve 76. The different elements then have the positions represented in FIGS. 3A and 3B. By screwing onto the threaded rod a nut (not shown) which comes up against the bottom face of the apparatus 16, the control sleeve is pulled downward and penetrates into the expander mandrel 47 until the stop 77 comes against the top end of the mandrel. Further downward movement of the control sleeve moves the mandrel 47 until the flexible ring 56 is against the shoulder 57. By means of a suitable tool going through the openings 59, one can compress the flexible ring 56 to clear the shoulder 57, and then continue to pull the control sleeve downward. When the heels of the connecting keys 82 reach the top edge of the flange 75, the keys go into the groove 58 of the slide and remain in this groove under the action of the flange 75. During this downward movement, the springs 48 and 93 are compressed. When the cap 87 comes down against the top end of the sub 62 of the support 60, the head 66 and the axial rod 72 are raised slightly and the pin 91 is inserted. The sheath 92 is refitted and the threaded rod (not shown) is unscrewed from the thread 80. The preparation at the surface is then completed, and the different elements have the relative positions shown in FIGS. 2A and 2B.

The running tool is screwed to the assembly 24 via the threaded boss 69 and the assembly is lowered into the production tubing by means of a flexible wire line 25. Upon reaching the landing nipple 15, the shoulder 40 of the anchoring device 22 stops against the shoulder 21. By means of the jar, one applies downward impacts to the head 66 to effect shearing of the release pin 91. In fact, the cap 87 is against the top of the sub 62 of the support 60, itself against the body 30 of the anchoring device 22 through the shoulder 64. The shearing of the pin 91 releases the control sleeve 76 which moves upward with the slide 47 since it is connected to the sleeve by the connecting keys 82, under the combined action of the springs 93 and 48. During this upward movement, the sleeve 76 and the mandrel 47 remain secured to each other until the heels of the keys 82 reach the top edge of the flange 75. At that instant, the anchoring dogs 42 have been pushed outward by the expander surface 52, and the flexible ring 56 is located over the shoulder 57. The mandrel 47 thus is already locked in the upper position. The connecting keys 82 are then freed from the groove 58, and the sleeve 76 and slide 47 continue their upward movement under the thrust of the springs 48 and 93 until the positions shown in FIGS. 3A and 3B are attained. Upward jarring is utilized to shear the tangential pins 36 and the running tool 23 can be raised to the surface (FIG. 1) leaving in place the apparatus 16 held firmly in the production string by the anchoring device 22.

If, during placement, the anchoring device becomes blocked in the landing nipple 15 and if, in addition, the dogs 42 do not fit perfectly into place in the locking groove 20, the mandrel 47 cannot be moved upward beyond a position in which the bottom edge 52 of the groove 51 bears against the bottom of the dogs 42. This situation can occur, for example, if the anchoring device is not sufficiently inserted in the nipple 15 for the dogs 42 to be opposite the groove 20. In this case, the connecting keys 82, the heels of which are still against the flange 75, retain the control sleeve connected to the mandrel 47. A safety system is provided however to free the running tool from the anchoring device under the aforementioned circumstances. By means of the jar, upward impacts are imparted to the head 66 of the running tool. The impacts are transmitted to the support 60 via the shoulder 71 and shear the tangential pins 36 to disconnect the support 60 from the upper sub 31 of the anchoring device 22. By continued upward jarring, the pins 90 will also be sheared since the upward impacts are applied, via the support sub 62, to the bottom part of the cap 87, and since the control sleeve 76 is lodged in the anchoring device 22. The control sleeve 76 then becomes separated from the cap 87 and it is possible to move the head 66, the support 60 and the axial rod 72 upward relative to the control sleeve until the bottom of the flange 75 clears the heels of the connecting keys 82. Then the keys 82 can disengage from the groove 58 and the entire running tool can be brought up to the surface. During surface inspection of the running tool, the shearing of the pins 90 will provide a tell-tale indication that the slide 47 did not reach its upper position and that, consequently, the anchoring of the apparatus 16 in the production string is not reliable. Under these conditions, it will be preferable to retrieve the apparatus 16 and the anchoring device in order to carry out the placement correctly.

The retrieval can be accomplished by lowering into the borehole, at the end of the wire line 25, a conventional device such as the type "GS" fishing tool marketed by the company OTIS. Such a tool is designed to push downward the mandrel 47 after shearing of the pins 53, and to engage in the groove 38 of the body 30 to allow the anchoring device 22 and the apparatus 16 to be brought up to the surface.

The devices just described thus present a certain number of advantages. The locking system of the expander mandrel 47 prevents any return of the mandrel toward the position releasing the anchoring wedges 42. The spring 48 placed between the body 30 and the mandrel 47 is entirely protected against any erosion due to fluids flowing in the production string or any snagging by a tool moved through this string. The running tool, due to its spring 93, makes it possible to apply a significant upward force for the anchoring of the dogs. If the pin 90 is not sheared, this indicates correct anchoring in the production tubing. Finally, the shearing of this pin 90 constitutes a safety system making it possible to free the running tool from the anchoring device event in the event of incorrect functioning or jamming of the latter.

Since certain changes or modifications may be made in the disclosed embodiment without departing from the inventive concepts involved, it is the aim of the amended claims to cover all such changes and modifications falling within the true spirit and scope of the present invention.

I claim:

1. Apparatus for use in anchoring a device in a well conduit, comprising: a tubular body member; anchoring means mounted on said body member for movement between retracted and extended positions; expander means movable longitudinally within said body member between first and second longitudinally spaced positions for respectively enabling retraction and causing extension of said anchoring means; detent means releasably connected to said expander means and operative upon movement of said expander means to said second position for locking said expander means to said body member; and means for disconnecting said detent means from said expander means to enable return of said expander means to said first position.

2. The apparatus of claim 1 wherein said disconnecting means includes a stop member arranged for normally preventing substantial movement of said detent means relatively along said expander means, and shear means for releasably attaching said stop member to said expander means.

3. The apparatus of claim 2 wherein said top member is constituted by a ring encircling said expander means, said detent means being received in recess means on said expander means defined in part by a surface of said ring.

4. The apparatus of claim 1 further including spring means reacting between said body member and said expander means for biasing said expander means toward said second position.

5. Apparatus for use in installing a device in a well conduit, comprising: a tubular body member carrying anchoring means that are movable between retracted and extended positions; expander means movable longitudinally within said body member between first and second longitudinally spaced positions for respectively enabling retraction and causing extension of said anchoring means; a support adapted to be releasably attached to said body member; a control sleeve movable longitudinally within said support; connecting means on said control sleeve engageable with said expander means for coupling said control sleeve and expander means together during movement between said first and second positions; means for maintaining said connecting means engaged with said expander means during movement from said first position to said second position; and means for freeing said connecting means from said expander means when said expander means reaches said second positions.

6. The apparatus of claim 5 wherein said maintaining means comprises a rod coupled to said support and arranged inside said control sleeve, said rod having an enlarged diameter surface coacting with said connecting means to maintain said connecting means engaged with said expander means, and wherein said freeing means comprises a recessed surface on said rod coacting with said connecting means for releasing said connecting means from engagement with said expander means.

7. The apparatus of claim 6 further including spring means for biasing said control sleeve and said expander means toward said second position; and releasable means for securing said control sleeve and expander means in said first position.

8. The apparatus of claim 7 wherein said releasable means comprises shear means for releasably connecting said control sleeve to said rod, and means for enabling said shear means to be sheared in response to longitudinally directed force applied to said rod.

9. The apparatus of claim 8 wherein said enabling means comprises coupling means allowing limited travel of said rod relative to said support in a first longitudinal direction, and stop means on said support for preventing longitudinal movement of said control sleeve in said first longitudinal direction.

10. The apparatus of claim 6 further including safety means for releasing said connecting means from engagement with said expander means in the event said expander means is unable to move from said first position to said second position.

11. The apparatus of claim 10 wherein said safety means includes shear means which when disrupted allows said rod and said support to be moved longitudinally relative to said control sleeve to a position where said enlarged diameter surface of said rod is ineffective to maintain said connecting means engaged with said expander means.

12. A running tool comprising: a support; a control sleeve movable longitudinally within said support between first and second positions and having attachment means movable between extended and retracted positions; a rod coupled to said support and extending within said control sleeve, said rod having first surface means engaging said attachment means in said first position for extending said attachment means and second surface means adapted to be positioned adjacent said attachment means in said second position for allowing retraction of said attachment means; releasable means for holding said control sleeve in said first position; and means for shifting said control sleeve relatively along said support and said rod from said first position to said second position upon release of said releasable means.

13. The running tool of claim 12 wherein said releasable means comprises shear pin means connecting said control sleeve to said rod, and wherein said shifting means comprises a compressed coil spring reacting between said support and said control sleeve.

14. The running tool of claim 13 wherein said control sleeve has upper and lower portions, said lower portion carrying said attachment means and said upper portion being releasably connected to said rod, and further including safety means for releasably connecting said upper and lower portions to one another.

15. The running tool of claim 14 wherein said safety means comprises shear means which when disrupted allows said rod and said support to be moved longitudinally relative to said lower portion of said control sleeve to a position where said first surface means is out of engagement with said attachment means to allow said attachment means to retract.

* * * * *